US005085293A

United States Patent [19]

Aime

[11] Patent Number: 5,085,293

[45] Date of Patent: Feb. 4, 1992

[54] APPARATUS FOR AUTOMATICALLY SEALING THE SPACE BETWEEN AN ELEVATOR SHAFT AND AN ELEVATOR CAR

[75] Inventor: Michael Aime, Maurepas, France

[73] Assignee: Inventio AG, Switzerland

[21] Appl. No.: 662,323

[22] Filed: Feb. 22, 1991

Related U.S. Application Data

[63] Continuation of Ser. No. 382,903, Jul. 20, 1989, abandoned.

[30] Foreign Application Priority Data

Jul. 25, 1988 [CH] Switzerland ..... 02833/88

[51] Int. Cl.[5] ..... B66B 9/00

[52] U.S. Cl. ..... 187/1 R; 187/51; 49/477; 277/34.6

[58] Field of Search ..... 187/1 R, 51, 56, 98; 49/303, 304, 305, 477, 476, 210; 277/27, 29, 28, 34, 34.6, 201

[56] References Cited

U.S. PATENT DOCUMENTS

| | | | |
|---|---|---|---|
| 3,359,687 | 12/1967 | Wallace | 49/477 |
| 3,371,986 | 3/1968 | Brown | 49/477 |
| 3,518,355 | 6/1970 | Luce | 49/477 |
| 4,058,191 | 11/1977 | Balbo | 187/1 R |
| 4,150,509 | 4/1979 | Knap | 49/477 |
| 4,665,653 | 5/1987 | Franz et al. | 49/477 |
| 4,722,151 | 2/1988 | Westwell | 49/477 |
| 4,735,293 | 4/1988 | Everhart et al. | 187/56 |
| 4,761,917 | 8/1988 | Knecht et al. | 49/477 |

FOREIGN PATENT DOCUMENTS

| | | |
|---|---|---|
| 3336357 | 4/1985 | Fed. Rep. of Germany . |
| 1451678 | 9/1966 | France . |

*Primary Examiner*—Robert P. Olszewski
*Assistant Examiner*—Kenneth Noland
*Attorney, Agent, or Firm*—William J. Clemens

[57] ABSTRACT

A sealing apparatus has inflatable hallow body portions extending around a car opening to close off the space between an elevator shaft wall and the car opening of an elevator car in a draftsproof and weatherproof manner when stopping at a floor. After the car stops at a floor, a pressurized fluid medium is utilized to inflate the hollow body until it is pressed against the shaft wall. The hollow body of the sealing apparatus is ventilated to atmosphere or to a vacuum before the departure of the elevator car from the floor such that the hollow body retracts so as to assure the spacing which is necessary for the free travel of the elevator car in the shaft. The sealing apparatus is monitored for low and excess pressure conditions.

18 Claims, 3 Drawing Sheets

APPARATUS FOR AUTOMATICALLY SEALING THE SPACE BETWEEN AN ELEVATOR SHAFT AND AN ELEVATOR CAR

This application is a continuation of U.S. patent application Ser. No. 07/382,903, filed July 20, 1989 and now abandoned.

BACKGROUND OF THE INVENTION

The invention generally concerns an apparatus for sealing the space between an elevator shaft wall and the elevator car opening and, in particular, such an apparatus for automatically sealing the space when the car stops at a floor.

A sealing apparatus, which consists of flaps with deformable ends arranged around the elevator car opening, is shown in U.S. Pat. No. 4,058,191. When stopping at a floor, the flaps are tilted towards the shaft wall in dependence on the movement of the car door. The deformable ends of the flaps are then pressed by the flaps against the shaft wall in such a manner that a weatherproof closure is created across the space between the car body and the elevator shaft wall. The flaps are pivotably attached at the edges of the car door opening. They are tilted towards the shaft wall or away from the shaft wall by means of rollers and cams in dependence on the car door movement.

A disadvantage of this known apparatus is its complicated mechanical structure and the high manufacturing costs associated therewith. A further disadvantage is the relatively high level effort required with respect to adjustment and maintenance operations.

SUMMARY OF THE INVENTION

The present invention solves the problems associated with the prior art devices by providing a sealing apparatus which is mechanically less complex and operates independently of the car door movement. Thus, the sealing apparatus according to the present invention provides a substantial savings in technical effort and is less susceptible to failures. A further advantage of the present invention is a more rapid mode of operation of the sealing apparatus becomes possible through the independence from the door movement. Another advantage is that the sealing effectiveness is improved substantially.

The sealing apparatus according to the present invention includes an inflatable hollow body connected to a support body which is mounted on the elevator car around the car door. Upon the stopping of the car at a floor, an elevator control connects a source of pressured fluid to the interior of the hollow body to expand against the adjacent wall of the elevator shaft and seal the space between the car and the shaft wall. Two embodiments are shown in which two chambers expand in the manner of a balloon or a hinged chamber expands in a scissors-like manner. When the car is ready for departure, the hollow body is vented to the atmosphere or to a vacuum source.

The sealing apparatus can be included in a system having a source of pressured fluid such as compressed air generated by a compressor with an auxiliary source such as a compressed air cylinder. The pressured fluid from the source flows through a pressure-regulating valve into a pressure fluid reservoir which feeds electromagnetically actuated three/two-way valves. The hollow body can be formed in more than one portion and each portion is connected to an outlet of an associated one of the three/two-way valves. The feed pressure is monitored by a pressure switch connected between the pressure-regulating valve and the reservoir and the fluid pressure in each sealing apparatus portion is monitored by a separate pressure switch connected to an outlet of an associated one of the three/two-way valves. The elevator control is connected to all of the pressure switches for generating an alarm in the case of low or excess feed pressure and to start the car when the sealing apparatus has been deflated.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
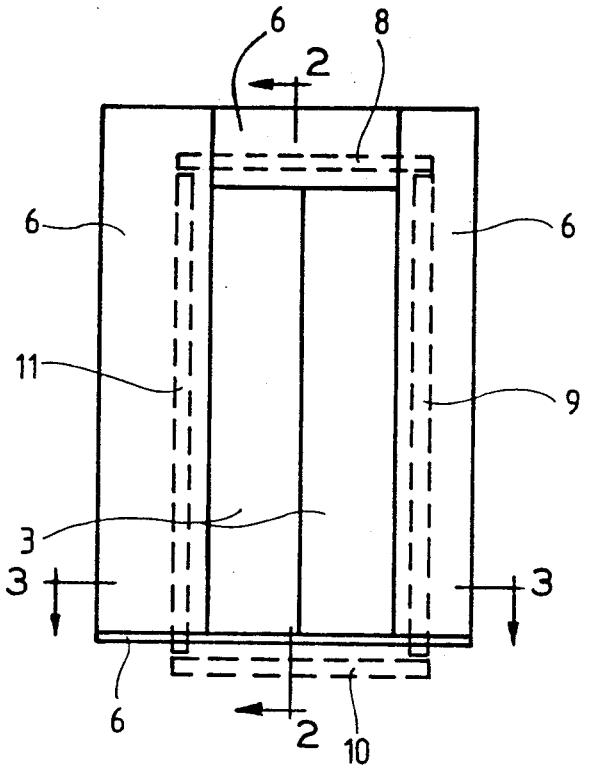
FIG. 1 is a front elevational view of an elevator car entry/exit door including a sealing apparatus according to the present invention.
Figure 2:
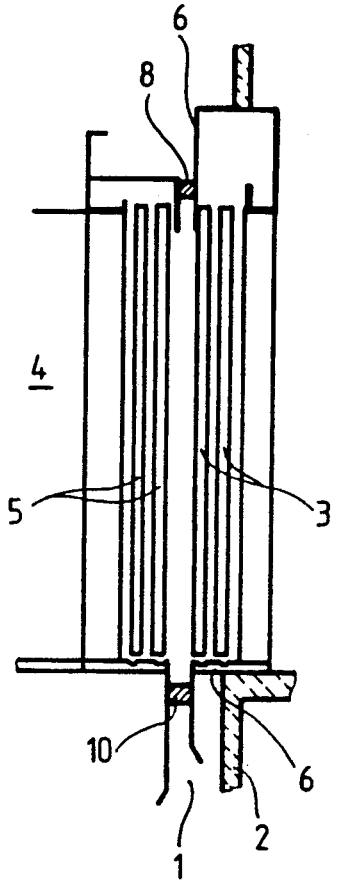
FIG. 2 is a cross-sectional of the elevator car taken along the line 2—2 in FIG. 1.
Figure 3:
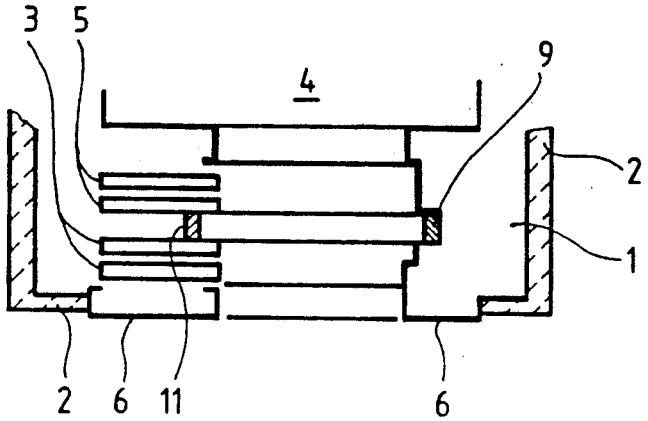
FIG. 3 is a cross-sectional view of the elevator car taken along the line 3—3 in FIG. 1.

As shown in FIGS. 1 through 3, an elevator shaft 1 is bounded by a shaft wall 2 and an opening in the wall at a floor is closed by sliding shaft doors 3. An elevator car 4 with sliding car doors 5 is guided in the shaft 1. The shaft opening is surrounded by a shaft closure 6. A sealing apparatus 7 formed of an elastic material is positioned around the opening in the car 4. The sealing apparatus 7 includes of an upper portion 8, a righthand portion 9, a lower portion 10 and a lefthand portion 11. Each of the portions 8 through 10 have a cross-section as illustrated in the FIGS. 4 and 5 or, alternatively, a cross-section as illustrated in the FIGS. 6 and 7.

Figure 4:
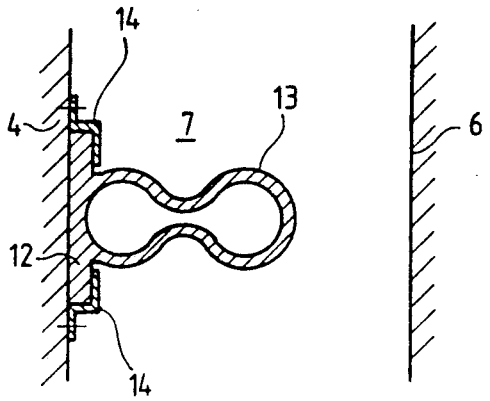
FIG. 4 is an enlarged cross-sectional view of a first embodiment of the sealing apparatus of FIG. 1 with balloon-like expansion in the pressure-free state.
Figure 5:
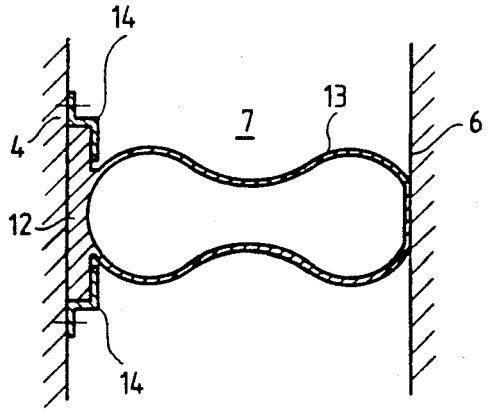
FIG. 5 is a view, similar to FIG. 4, of the sealing apparatus in the charged state.

As shown in FIGS. 4 and 5, the sealing apparatus 7 has a support body 12 connected to a hollow body 13 which bodies can be formed integral, as shown, or as separate elements. A fastening strip 14 attached to the side of the car 4 retains the support body 12. The hollow body 13 expands in the manner of a balloon. In the example of the second embodiment according to FIGS. 6 and 7, a sealing apparatus 7' has a support body 12' and a hollow body 13' expands in a scissors-like manner by way of longitudinally extending, spaced apart hinges 15.

Figure 8:
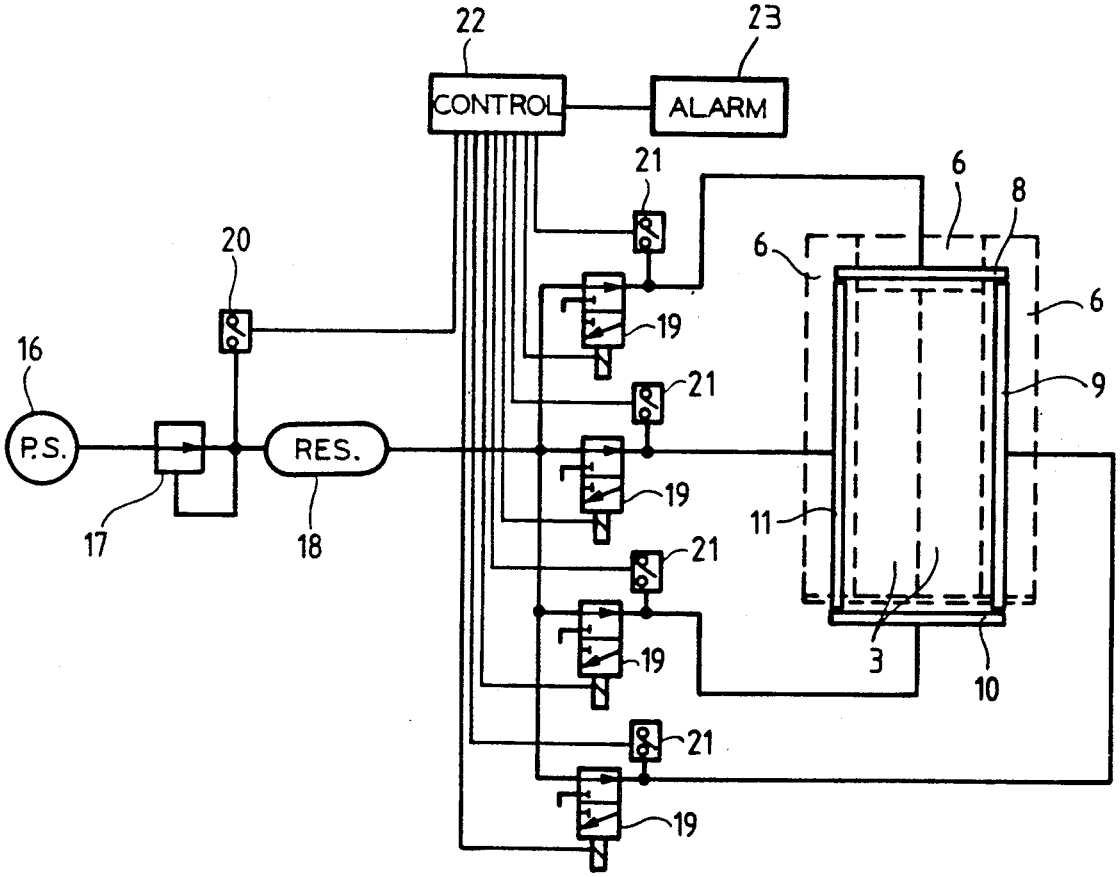
FIG. 8 is a schematic circuit diagram of a pressure medium supply and pressure medium control for the sealing apparatus according to the present invention.

The sealing apparatus 7 or 7' is expanded by pressured fluid from a source 16 as shown in FIG. 8. The pressured fluid source 16 includes a compressor and an auxiliary pressured fluid source, for example a compressed air cylinder. In the case of failure of the compressor, the pressure is maintained automatically by the auxiliary pressure source. The pressure medium compressed by the pressured fluid source 16 flows by way of a pressure-regulating valve 17 into a pressured fluid reservoir 18, which in turn feeds four electromagnetically actuated three/two-way control valves 19. The portions 8, 9, 10 and 11 of the sealing apparatus 7 are each connected to a first outlet opening of an associated one of the three/two-way valves 19. The pressure medium feed takes place by way of a not illustrated opening in the support body 12. The feed pressure is monitored by a pressure switch 20 connected to a point between the valve 17 and the reservoir 18, and the fluid pressure in the sealing apparatus 7 is monitored by four pressure switches 21 each connected to an outlet of an associated one of the control valves 19. An elevator control 22 is connected to the valves 19, the switch 20 and the switches 21 for controlling the operation of the electromagnetically actuated valves 19.

Figure 6:
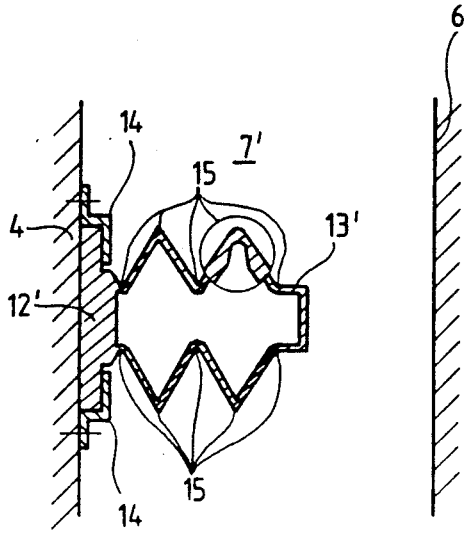
FIG. 6 is an enlarged cross-sectional view of a second or alternate embodiment of the sealing apparatus of FIG. 1 with scissors-like expansion in the pressure-free state.

The hollow bodies 13 and 13' shown in the FIGS. 4 and 6 respectively are dimensioned in the pressure-free state in such a manner that a predetermined spacing from the wall of the shaft closure 6 is assured, which spacing is necessary for the free travel of the elevator car 4 in the elevator shaft. The pressured medium, which is applied at the stopping of the elevator car 4 at a floor, flows in by way of a not illustrated opening in the support body 12 or 12' to expand the elastic hollow body 13 or 13' respectively. The body 13 is formed with two chambers lying one behind the other in the direction of the shaft closure 6. The chambers expand in the manner of a balloon as shown in FIG. 5 so that the body 13 presses against the wall of the shaft closure 6 and in that case seals off the space between the elevator car 4 and the shaft closure wall in a draftproof and weatherproof manner.

Figure 7:
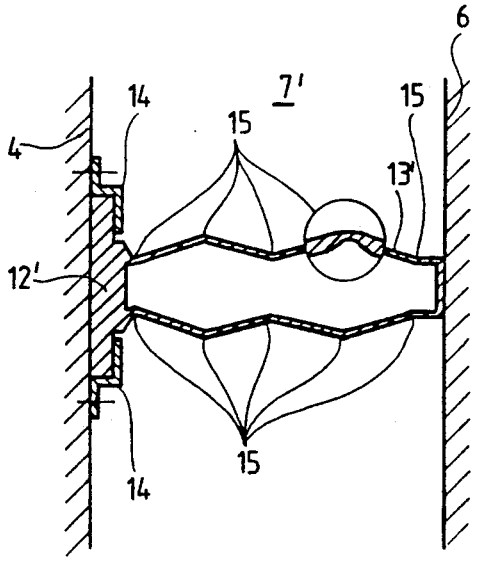
FIG. 7 is a view, similar to FIG. 6, of the sealing apparatus in the charged state.

The elastic hollow body 13', shown in the FIGS. 6 and 7 as a second embodiment, is expanded by the pressured medium in the manner of shears in the direction of the wall of the shaft closure 6. The bellows-like hollow body 13' has hinges 15 formed as places of reduced wall thicknesses at possible kink points. Before the departure of the elevator car 4 from the floor, the hollow body 13 or 13' is ventilated to the atmosphere. The elasticity inherent in the material of the hollow body 13 or 13' in that case returns the body to its initial shape according to the FIGS. 4 and 6 respectively.

The pressure-regulating valve 17 shown in the FIG. 8 supplies the feed pressure desired for the sealing apparatus 7 provided that the pressured fluid produced by the pressured fluid source 16 is higher than the pressure required for actuating the sealing apparatus 7. The feed pressure is monitored by the pressure switch 20, which in the case of lack of pressure or excess pressure generates a pressure signal to the elevator control 22. This signal initiates an alarm of second priority in the case of lack of pressure and an alarm of first priority in the case of excess pressure. As soon as the elevator car 4 has arrived at the stopping point, the elevator control 22 actuates the three/two-way valves 19 electrically from a second setting, ventilating the sealing apparatus 7 to the atmosphere, to a first setting charging the sealing apparatus 7 with the fluid pressure. The driving sequence of the three/two-way valves 19 is determined by the elevator control 22 in dependence on the arrangement of the portions 8, 9, 10 and 11 around the door opening. In the normal case, the vertically arranged portions 9 and 11 are the first to be charged with pressured fluid. The elevator control 22 permits the departure of the elevator car 4 from the stopping point at a floor only after all the pressure switches 21 report atmospheric pressure in all the sealing apparatus portions.

In a further example of the present invention, the sealing apparatus 7 can be ventilated to a vacuum instead of the ventilation to atmosphere. In this case, the second outlet opening of the three/two-way valves 19 is connected to the suction duct of a vacuum source 24 as indicated by a dashed line connected to the valve 19 associated with the righthand portion 9 shown in FIG. 8. The ventilation to a vacuum effects a more rapid deflation of the sealing apparatus 7 for departure of the elevator car 4.

In another embodiment, a single U-shaped portion extending around the upper righthand and lower righthand corner of the door opening can be provided in place of the portions 8, 9 and 10. The arrangement of only one vertical portion 11 and a portion encompassing three sides reduces the elements required in the control means.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for sealing the space between an elevator shaft wall and the opening of an elevator car when the car is stopped at a floor, comprising: an inflatable hollow body attached to an elevator car about a car door opening and an associated car door and adapted to be inflated by an application of a pressured fluid medium to close a space between the car and a wall of an elevator shaft in a draftproof and weatherproof manner when the car is stopped at a floor; a source of pressured fluid medium connected to said body through a valve; and an elevator control means connected to said valve for inflating said body after the car arrives at a stopping point and deflating said body before the car departs the stopping point, said elevator control controlling movement of the car in the shaft and operation of the car door and automatically controlling said valve independently of the operation of the car door.

2. The apparatus according to claim 1 wherein said sealing apparatus extends around the door opening of the elevator car with at least two separately inflatable portions each extending along at least one side of the door opening.

3. The apparatus according to claim 1 wherein said sealing apparatus is formed with an elastic hollow body for sealing the space between the car and the shaft wall and a support body connected to said elastic hollow body for attaching said sealing apparatus to the elevator car.

4. The apparatus according to claim 3 wherein said hollow body includes chambers which lie one behind the other in the direction of the shaft wall and expand in the manner of a balloon under the influence of a pressured fluid medium.

5. The apparatus according to claim 3 wherein said hollow body is formed as a bellows which expands in the manner of scissors in the direction of the shaft wall under the influence of a pressured fluid medium.

6. The apparatus according to claim 5 including a plurality of hinges formed at the kink points of said bellows for the expansion in the manner of scissors.

7. The apparatus according to claim 6 wherein said hinges are formed as longitudinally extending areas of reduced thickness in a wall of said bellows.

8. The apparatus according to claim 1 wherein said source of pressured fluid medium for the operation of said sealing apparatus is connected through a pressure-regulating valve to a pressure reservoir, and said valve is a three/two-way valve connected between said pressure reservoir and said sealing apparatus for inflating and deflating said sealing apparatus.

9. The apparatus according to claim 8 wherein said control means is an elevator control connected to said three/two-way valve for actuating said valve to permit pressured fluid to flow into said sealing apparatus upon the arrival of the elevator car at a floor.

10. The apparatus according to claim 8 wherein said control means is an elevator control connected to said three/two way valve for venting said sealing apparatus to the atmosphere before the departure of the elevator car from a floor.

11. The apparatus according to claim 8 wherein said control means is an elevator control connected to said three/two-way valve for venting said sealing apparatus to a vacuum before the departure of the elevator car from a floor.

12. The apparatus according to claim 8 wherein said source of pressured fluid medium includes a compressor and an auxiliary pressure source whereby in the case of a failure of said compressor, said auxiliary pressure source automatically maintains the pressure of the fluid medium.

13. A system for sealing the space between an elevator shaft wall and the opening of an elevator car when the car is stopped at a floor, comprising:

an inflatable hollow body attached to an elevator car about a door opening, said hollow body being retracted when deflated to permit free travel of the elevator car in an elevator shaft;

a source of pressured fluid;

a control valve connected between said source of pressured fluid and said hollow body;

a pressure-regulating valve connected between said source of pressured fluid and said control valve;

control means connected to said control valve for inflating said hollow body from said source of pressured fluid when the car is stopped at a floor and for venting said hollow body through said control valve before the car leaves the floor;

a pressure switch connected between an outlet of said pressure-regulating valve and said control means; and an alarm connected to said control means whereby said alarm is actuated by said control means when said pressure switch senses a low pressure condition and an excess pressure condition.

14. The sealing system according to claim 13 wherein said control valve is a three/two-way valve.

15. The sealing system according to claim 13 including a support body attached to said hollow body and a fastening strip for attaching said support body to the elevator car.

16. An apparatus for sealing the space between an elevator shaft wall and the opening of an elevator car when the car is stopped at a floor, comprising:

at least two sealing portions, each said sealing portion having an inflatable hollow body connected to a support body;

a fastening strip for attaching each of said support bodies to an elevator car about a door opening;

a source of pressured fluid;

a separate control valve connected between said source of pressure fluid and an associated one of each of said sealing portions; and an elevator control means connected to said control valves for inflating said hollow bodies after the elevator car arrives at a floor and for deflating said hollow bodies before the elevator car departs the floor, said elevator control controlling movement of the car in an elevator shaft and operation of a car door of the car and automatically controlling said valves independently of the operation of the car door in the door opening.

17. The sealing apparatus according to claim 16 including a pressure switch connected between an outlet of said source of pressured fluid and said control means and an alarm connected to said control means whereby said control means actuates said alarm in response to said pressure switch sensing low pressure and excess pressure conditions at said outlet of said pressured fluid source.

18. The sealing apparatus according to claim 17 including further pressure switches each connected between an outlet of an associated one of said control valves and said control means for sensing when said associated hollow body is deflated.

* * * * *